US012492848B2

(12) United States Patent
Ueda et al.

(10) Patent No.: US 12,492,848 B2
(45) Date of Patent: Dec. 9, 2025

(54) HERMETIC TYPE COMPRESSOR

(71) Applicant: FUJITSU GENERAL LIMITED, Kanagawa (JP)

(72) Inventors: Kenshi Ueda, Kanagawa (JP); Naoya Morozumi, Kanagawa (JP); Naoto Tada, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 88 days.

(21) Appl. No.: 18/568,020

(22) PCT Filed: Jun. 6, 2022

(86) PCT No.: PCT/JP2022/022814

§ 371 (c)(1),
(2) Date: Dec. 7, 2023

(87) PCT Pub. No.: WO2022/260008

PCT Pub. Date: Dec. 15, 2022

(65) Prior Publication Data

US 2024/0133594 A1 Apr. 25, 2024
US 2024/0230174 A9 Jul. 11, 2024

(30) Foreign Application Priority Data

Jun. 7, 2021 (JP) ..... 2021-095069

(51) Int. Cl.
*F25B 31/02* (2006.01)
*F04C 23/00* (2006.01)
*F04C 29/12* (2006.01)

(52) U.S. Cl.
CPC ..... *F25B 31/026* (2013.01); *F04C 23/008* (2013.01); *F04C 29/12* (2013.01)

(58) Field of Classification Search
CPC .. F01C 1/22; F01C 1/344; F01C 17/02; F01C 21/008; F02B 55/02; F02B 55/08;
(Continued)

(56) References Cited

U.S. PATENT DOCUMENTS 4,526,522 A * 7/1985 Onoda ..... B23K 9/007 219/127
5,261,800 A * 11/1993 Sakae ..... F04C 23/008 29/525

(Continued)

FOREIGN PATENT DOCUMENTS

CN 202117925 U * 1/2012
CN 202992437 U 6/2013

(Continued)

OTHER PUBLICATIONS

JP2565746_Translation, #5746, Mar. 18, 2012.*
CN202117925_translation, Masao, Jan. 18, 2012.*

*Primary Examiner* — Jesse S Bogue
(74) *Attorney, Agent, or Firm* — Paratus Law Group, PLLC

(57) ABSTRACT

A compressor main body container includes a main shell having a vertical cylindrical shape, a top shell having a cup shape, and a bottom shell having a cup shape, and an interior portion of the main shell is hermetically sealed by securing an opening side of the top shell to an upper end portion of the main shell at a first welded portion by welding, and securing an opening side of the bottom shell to a lower end portion of the main shell at a second welded portion by welding. The accumulator container includes an accumulator shell having a cup shape, and an interior portion of the accumulator shell is hermetically sealed by securing an opening side of the accumulator shell to an opposite opening side of the bottom shell at a third welded portion by welding (Continued)

at a position lower than a position of the second welded portion in the compressor main body container.

12 Claims, 3 Drawing Sheets

(58) Field of Classification Search
CPC .... F04C 18/0215; F04C 23/008; F04C 29/12; F25B 31/026
See application file for complete search history.

(56) References Cited

U.S. PATENT DOCUMENTS

| | | | | |
|---|---|---|---|---|
| 2016/0186754 | A1* | 6/2016 | Cho | F04C 29/023 418/55.1 |
| 2024/0309871 | A1* | 9/2024 | Ukai | F04C 29/12 |

FOREIGN PATENT DOCUMENTS

| | | | | |
|---|---|---|---|---|
| EP | 1577557 | A2 * | 9/2005 | F01C 21/0863 |
| JP | H03-202682 | A | 9/1991 | |
| JP | H06-066258 | A | 3/1994 | |
| JP | 2565746 | Y2 * | 3/1998 | |
| JP | 2011-117321 | A | 6/2011 | |
| JP | 2020-109283 | A | 7/2020 | |
| JP | 2023151330 | A * | 10/2023 | |
| JP | 2023151331 | A * | 10/2023 | |
| JP | 2025033483 | A * | 3/2025 | |
| WO | WO 2019/207719 | A1 | 10/2019 | |

* cited by examiner

HERMETIC TYPE COMPRESSOR

CROSS REFERENCE TO PRIOR APPLICATION

This application is a National Stage Patent Application of PCT International Patent Application No. PCT/JP2022/022814 (filed on Jun. 6, 2022) under 35 U.S.C. § 371, which claims priority to Japanese Patent Application No. 2021-095069 (filed on Jun. 7, 2021), which are all hereby incorporated by reference in their entirety.

FIELD

The present invention relates to a hermetic type compressor that compresses and conveys a refrigerant in a refrigeration machine or an air conditioner operated by using a refrigeration cycle.

BACKGROUND

There is a known compressor, as a hermetic type compressor, that is constituted to have a structure in which a compression section and a motor that drives the compression section are accommodated in an interior portion of a compressor main body container having a vertical cylindrical shape, and an accumulator container, which is used to separate a refrigerant into a gas refrigerant and a liquid refrigerant (hereinafter, sometimes referred to as "to separate a gas-liquid two-phase refrigerant") and which causes only the gas refrigerant to be sucked into a compression section, is provided at a lower part of the compressor main body container.

CITATION LIST

Patent Literature

Patent Literature 1: Japanese Laid-open Patent Publication No. 2020-109283

Patent Literature 2: Japanese Laid-open Patent Publication No. 3-202682

Patent Literature 3: Japanese Laid-open Patent Publication No. 6-66258

SUMMARY

Technical Problem

The compressor described in Patent Literature 1 is a compressor having a compression section with a rotary type. This compressor has a structure in which an accumulator container, which separates a gas-liquid two-phase refrigerant that is sucked into the compression section, is constituted by a container that is formed independently of a compressor main body container, and is arranged below the compressor main body container, and the compressor main body container is connected to the accumulator container by using a bracket. In the configuration described in Patent Literature 1, the compressor main body container and the accumulator container are constituted as independent containers, so that there is a problem in that the cost needed for the containers increases, and also, there is a problem in that the cost increases caused by the use of the bracket that connects the compressor main body container and the accumulator container.

The compressor described in Patent Literature 2 is a compressor having a compression section with a scroll type.

This compressor has a structure in which an accumulator container is directly bonded to a lower part of a compressor main body container that accommodates a compression section and a motor that drives the compression section. Specifically, in a first embodiment described in Patent Literature 2, the compressor main body container is constituted by a main shell having a vertical cylindrical shape, a top shell that blocks an upper end portion of the main shell and that has a cup shape, and a bottom shell that blocks a lower end portion of the main shell and that has a cup shape, and furthermore, the accumulator container is constituted by using a space, as an area of the accumulator container, that is hermetically sealed by the bottom shell and the accumulator shell by securing the opening side of the cup shaped accumulator shell to the lower side of the bottom shell by welding. In other words, the bottom shell is constituted by using both a part of the compressor main body container and a part of the accumulator container. The bottom shell is provided with a compression section suction pipe that passes through the bottom shell, and a refrigerant, contained in the interior portion of the accumulator container, is sucked to a compression section through a compression section suction pipe.

In the configuration described above, both of the main shell and the accumulator shell are secured to the bottom shell at a single welded portion by being welded. In general, in a hermetic type compressor used for an air conditioner, prior to shipment, in order to check whether a poor weld occurs in the shells that constitute an airtight container, high-pressure gas is enclosed in an interior portion of the hermetic type compressor to check, in a water tank, whether or not the high-pressure gas leaks to the outside.

In the following, a description will be given of a path of a leakage of refrigerant gas occurring at the time of a poor weld is present at a single common welded portion in which the main shell and the accumulator shell are welded and secured to the bottom shell according to the first embodiment described in Patent Literature. The path of the leakage of the refrigerant gas includes the following two patterns depending on a pattern of a poor welded portion: a pattern that is one of three patterns of, as a first path, a leakage of refrigerant gas from the interior portion of the compressor main body container to the outside; as a second path, a leakage of refrigerant gas from the interior portion of the accumulator container to the outside; and, as a third path, a leakage of refrigerant gas from the interior portion of the compressor main body container to the interior portion of the accumulator container, or, a pattern that is a combination of two or more paths out of these three paths. The poor weld that becomes a cause of the leakage of the refrigerant gas from the interior portion of the compressor main body container to the outside, which corresponds to the first path, and the leakage of the refrigerant gas from the interior portion of the accumulator container to the outside, which corresponds to the second path, are able to be detected by a method of enclosing the high-pressure gas in a water tank and checking whether the high-pressure gas leaks to the outside; however, a poor weld that becomes a cause of the leakage of the refrigerant gas from the interior portion of the compressor main body container to the interior portion of the accumulator container, which corresponds to the third path, is not able to be detected by using this method. Accordingly there is a problem in that a high pressure refrigerant, which is present in the interior portion of the compressor main body container, leaks into the interior portion of a low pressure accumulator container at the time of an operation of the compressor, thereby leading to a decrease in efficiency and a decrease in reliability.

The compressor described in Patent Literature 3 has a structure in which an interior portion of an airtight container is divided by a pressure partition wall, an upper part of the pressure partition wall is used as a compressor main body container, in which a compression section and a motor are accommodated, and a lower part of the pressure partition wall is used as an accumulator container. In also the configuration described in Patent Literature 3, with the above explained checking method used in Patent Literature 2, it is difficult to detect a poor part of the welded portion between the inner circumferential surface of the airtight container and the pressure partition wall, and there is a problem in that a high pressure refrigerant, which is present in the interior portion of the compressor main body container, leaks into the interior portion of a low pressure accumulator container, thereby leading to a decrease in efficiency and a decrease in reliability.

Accordingly, the disclosed technology has been conceived in light of the circumstances described above, and an object thereof is to provide a highly reliable hermetic type compressor by reducing a manufacturing cost of a compressor, in which an accumulator container is arranged in a lower part of a compressor main body container, and preventing a leakage of a refrigerant from the compressor main body container to the accumulator container.

Solution to Problem

According to an aspect of an embodiments in the present application, a hermetic type compressor, in which, in an interior portion of a compressor main body container having a vertical cylindrical shape, a compression section that sucks and compresses a refrigerant and that discharges the refrigerant into the compressor main body container, and a motor that drives the compression section are accommodated, and that includes; below the compressor main body container, an accumulator container that separates a refrigerant, sucked from a refrigeration cycle, into a gas refrigerant and a liquid refrigerant, and that supplies the gas refrigerant to the compression section, wherein the compressor main body container includes a main shell having a vertical cylindrical shape, a top shell having a cup shape, and a bottom shell having a cup shape, and in which an interior portion of the main shell is hermetically sealed by securing an opening side of the top shell to an upper end portion of the main shell at a first welded portion by welding and by securing an opening side of the bottom shell to a lower end portion of the main shell at a second welded portion by welding, and the accumulator container includes an accumulator shell having a cup shape, and in which an interior portion of the accumulator shell is hermetically sealed by securing, by welding, an opening side of the accumulator shell to an opposite opening side of the bottom shell at a third welded portion that is located at a position lower than a position of the second welded portion in the compressor main body container.

Advantageous Effects of Invention

According to an aspect of an embodiment of a hermetic type compressor disclosed in the present application, it is possible to provide a highly reliable hermetic type compressor by reducing a manufacturing cost of a compressor, in which an accumulator is arranged below the compressor main body container, and preventing a leakage of a refrigerant from the compressor main body container to the accumulator container.

DESCRIPTION OF EMBODIMENTS

Preferred embodiments of a compressor, disclosed in the present invention, will be described in detail below with reference to the accompanying drawings. Furthermore, the compressor, disclosed in the present invention, is not limited by the embodiments described below.

Embodiment (Configuration of Rotary Compressor)

Figure 1:
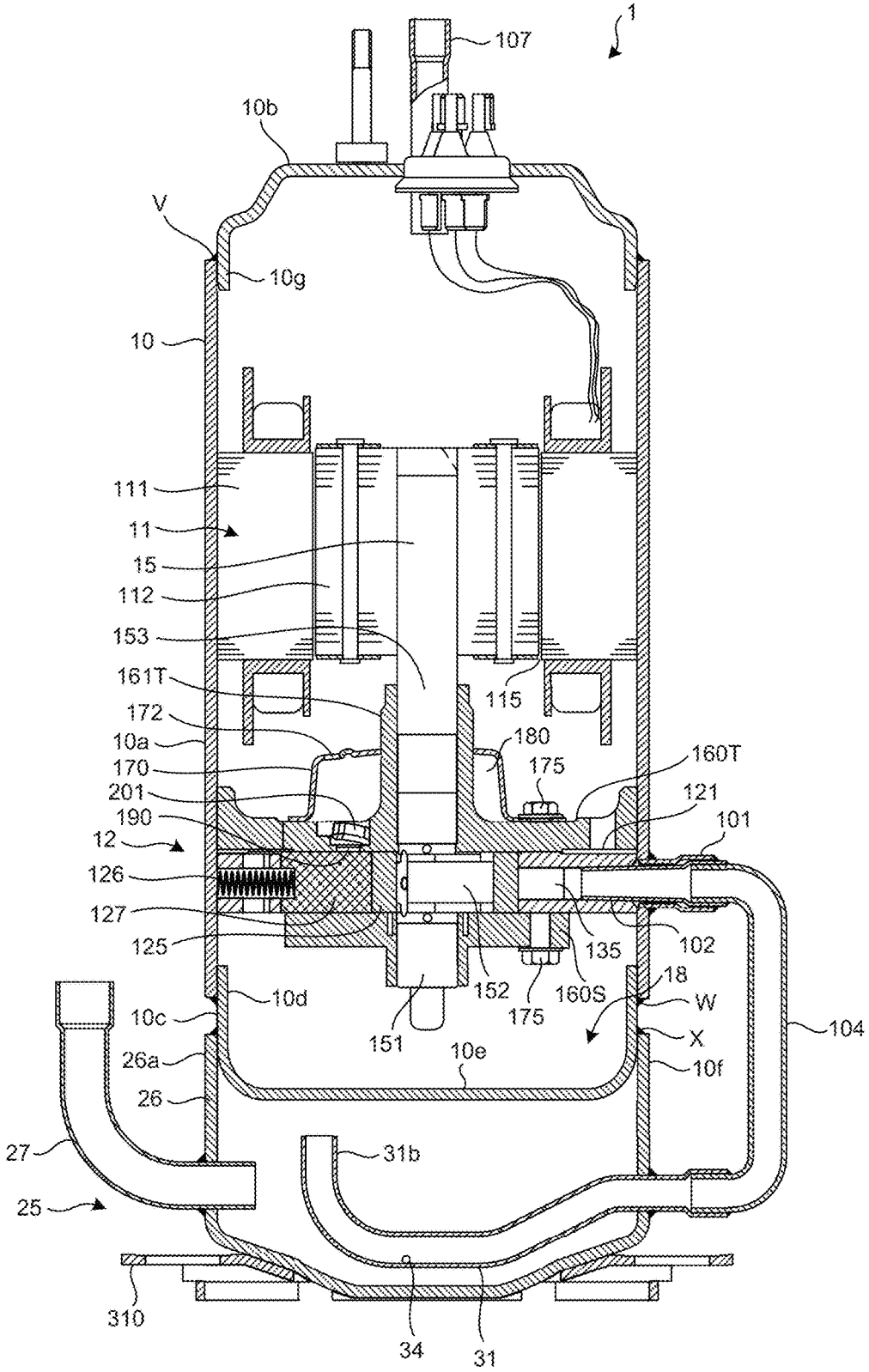
FIG. 1 is a longitudinal sectional diagram illustrating a rotary compressor according to an embodiment.
Figure 2:
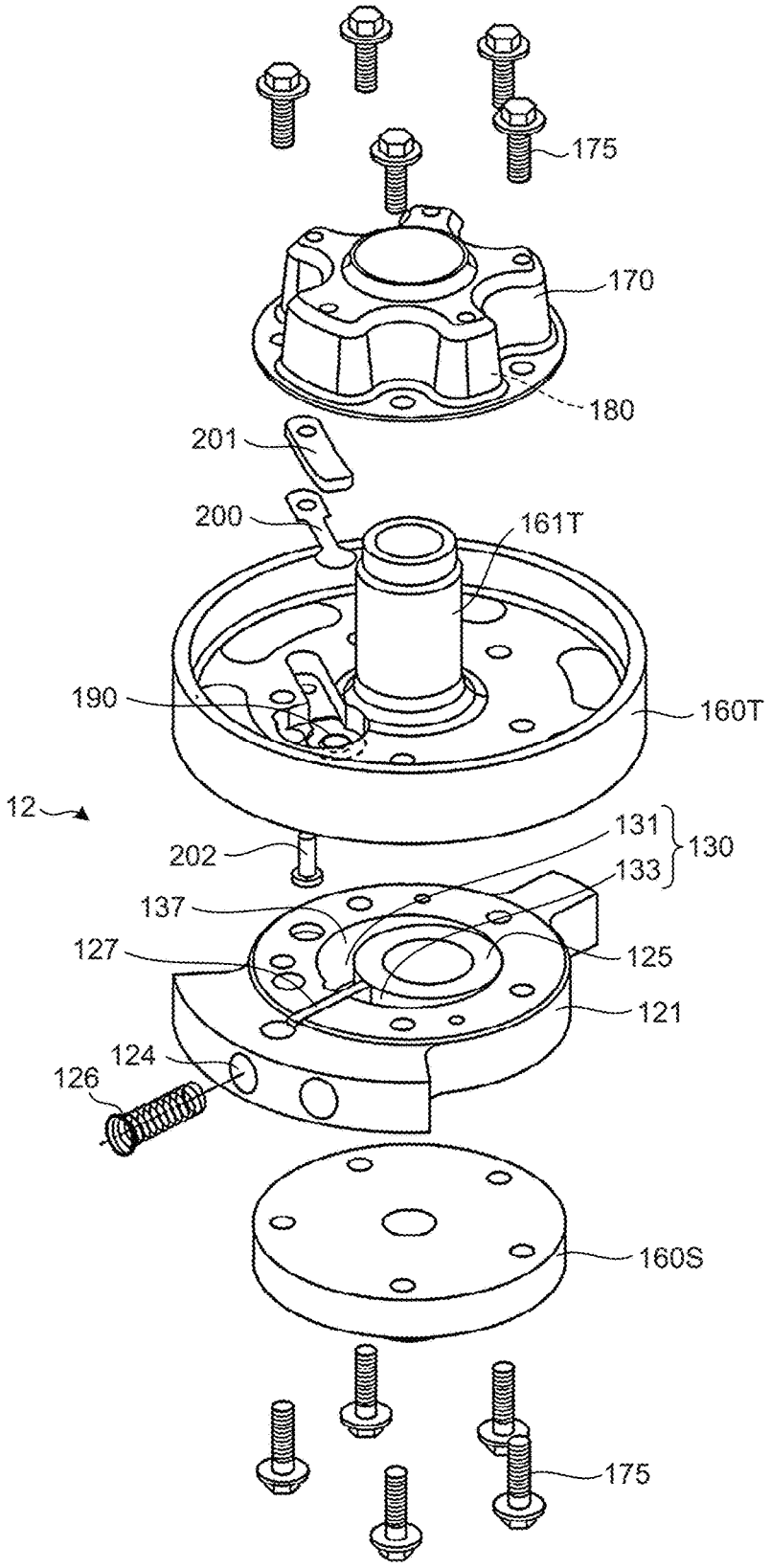
FIG. 2 is an exploded perspective diagram illustrating a compression section of the rotary compressor according to the embodiment.

In the present embodiment, a rotary compressor will be described as one example of a compressor. FIG. 1 is a longitudinal sectional diagram illustrating a rotary compressor according to an embodiment. FIG. 2 is an exploded perspective diagram illustrating a compression section of the rotary compressor according to the embodiment.

As illustrated in FIG. 1, a rotary compressor 1 is a hermetic type compressor with an internal high pressure type is constituted to have a structure in which a compression section 12 that sucks a refrigerant from a compression section suction pipe 102, that compresses the sucked refrigerant, and that discharges the compressed refrigerant to the interior portion of a compressor main body container 10, and a motor 11 that drives the compression section 12, are accommodated in an interior portion of a compressor main body container 10, and a high pressure refrigerant, which has been compressed by the compression section 12, is discharged to the interior portion of the compressor main body container 10, and is further discharged to a refrigeration cycle through a discharge pipe 107.

The compressor main body container 10 includes a main shell 10*a* having a vertical cylindrical shape, a top shell 10*b* having a cup shape, and a bottom shell 10*c* having a cup shape, and is constituted to have a structure in which an opening side 10*g* of the top shell 10*b* is secured to an upper end portion of the main shell 10*a* at a first welded portion V by performing a welding process, and an opening side 10*d* of the bottom shell 10*c* is secured to a lower end portion of the main shell 10*a* at a second welded portion W by performing a welding process.

The compression section suction pipe 102, which is used to suck a low pressure refrigerant in a refrigeration cycle into the compression section 12, is provided by passing through the main shell 10*a*. Specifically, a guide tube 101 is secured to the main shell 10*a* by being subjected to brazing, and the compression section suction pipe 102 passes through an inner side of the guide tube 101 and is secured to the guide tube 101 by being subjected to brazing.

In other words, a welded portion (a seventh welded portion), in which the guide tube 101 and the compressor main body container 10 are bonded, a welded portion (an eighth welded portion), in which the guide tube 101 and the compression section suction pipe 102 are bonded, and a welded portion (a ninth welded portion), in which the compression section suction pipe 102 and a communication pipe 104 are bonded, are provided on the outside of the compressor main body container 10. As a result of this, even when a poor weld occurs in the seventh, the eighth, and the ninth welded portions, it is possible to easily detect a leakage of refrigerant gas from the outside of the compressor main body container 10, so that it is possible to provide the highly reliable rotary compressor 1.

The discharge pipe 107 that is used to discharge a high pressure refrigerant, which has been compressed by the compression section 12, from the interior portion of the compressor main body container 10 to the refrigeration cycle, is provided by passing through the top shell 10*b*. The discharge pipe 107 is directly secured to the top shell 10*b* by being subjected to brazing.

An accumulator container 25 that is used to suck, into the compression section 12, only a gas refrigerant obtained by separating a low pressure gas-liquid two-phase refrigerant, which is sucked from the refrigeration cycle, is provided below the compressor main body container 10. Specifically, the accumulator container 25 is formed by securing an opening side 26*a* of an accumulator shell 26 to the opposite opening side 10*e* of the bottom shell 10*c* at a third welded portion X by performing a welding process and hermetically sealing the interior portion of the accumulator shell 26 at a position lower than the second welded portion W between the main shell 10*a* and the bottom shell 10*c* included in the compressor main body container 10.

In the accumulator shell 26, each of an accumulator suction pipe 27, which is used to suck a refrigerant into the interior portion of the accumulator container 25 from the refrigeration cycle, and a gas-liquid separation tube 31, which is used to convey a gas refrigerant from the interior portion of the accumulator, passes through the accumulator shell 26 and is secured to the accumulator shell 26 by being subjected to brazing.

The gas-liquid separation tube 31 is connected to the compression section suction pipe 102 on the outside of the accumulator container 25 via the communication pipe 104. An end portion of the gas-liquid separation tube 31, to which the communication pipe 104 is connected, is formed to have an expanded diameter such that one of the end portions of the communication pipe 104 is able to be inserted into the end portion of the gas-liquid separation tube 31. An end portion of the compression section suction pipe 102, to which the communication pipe 104 is connected, is formed to have an expanded diameter such that the other of the end portions of the communication pipe 104 is able to be inserted into the end portion of the compression section suction pipe 102. As a result of this, it is possible to easily connect the gas-liquid separation tube 31 and the communication pipe 104 on the outside of the accumulator container 25, and it is also possible to easily connect the compression section suction pipe 102 and the communication pipe 104 on the outside of the compressor main body container 10.

The communication pipe 104 extends along the vertical direction of each of the compressor main body container 10 and the accumulator container 25, and is connected to the gas-liquid separation tube 31 and the compression section suction pipe 102. The one end portion of the communication pipe 104 and the other end portion of the communication pipe 104 are bent along the radial direction of each of the compressor main body container 10 and the accumulator container 25. As a result of this, it is possible to facilitate an operation performed at a process of connecting the communication pipe 104 to the gas-liquid separation tube 31 and at a process of connecting the communication pipe 104 to the compression section suction pipe 102, and also, it is possible to form each of the pipes of the gas-liquid separation tube 31, the compression section suction pipe 102, and the communication pipe 104 in a simple shape. Consequently, it is possible to prevent an increase in the manufacturing cost of the rotary compressor 1.

Furthermore, a welded portion (a fourth welded portion), in which the gas-liquid separation tube 31 and the accumulator container 25 (the accumulator shell 26) are bonded, a welded portion (a fifth welded portion), in which the accumulator suction pipe 27 and the accumulator container 25 are bonded, and a welded portion (a sixth welded portion), in which the gas-liquid separation tube 31 and the communication pipe 104 are bonded, are provided on the outside of the accumulator container 25. As a result of this, even when a poor weld occurs in the fourth, the fifth, and the sixth welded portions, it is possible to easily detect a leakage of the refrigerant gas from the outside of the compressor main body container 10, so that it is possible to provide the highly reliable rotary compressor 1.

That is, each of the welded portions (the fourth welded portion to the ninth welded portion) of the accumulator suction pipe 27, the gas-liquid separation tube 31, and the communication pipe 104 each of which is connected to the rotary compressor 1, is provided on the outside of each of the accumulator container 25 and the compressor main body container 10, so that it is possible to easily detect a leakage of the refrigerant gas from the fourth welded portion to the ninth welded portion on the outside of the rotary compressor 1, and it is thus possible to form an appropriate welded portion by repairing the poor weld occurring at each of the welded portions.

A base member 310, which supports the entirety of the rotary compressor 1, is secured at the lower part of the accumulator shell 26 by performing a welding process. The accumulator shell 26 has a bottom surface that has a concave shape curved in a downward direction of the accumulator shell 26. Furthermore, in the interior portion of the accumulator shell 26, the gas-liquid separation tube 31 is bent along the bottom surface of the accumulator shell 26, and the gas-liquid separation tube 31 is arranged at a position closer to the vicinity of the bottom surface of the accumulator shell 26.

Accordingly, a liquid return hole 34, which will be described later, provided in the gas-liquid separation tube 31, can be arranged at a position closer to the bottom portion of the accumulator shell 26, in which the liquid refrigerant is accumulated, so that, as will be described later, it is possible to easily return lubricating oil 18 to the compression section 12 by way of the liquid return hole 34 together with the liquid refrigerant, accumulated in the bottom portion, and it is thus possible to appropriately seal the compression section 12 by the lubricating oil 18.

Furthermore, as described above, the accumulator shell 26 is supported by the base member 310, and the shape of the lower part of the accumulator shell 26 is formed in a shape along a placement surface of the base member 310. As a result of this, for example, the base member 310 is used as a part, which is common to a part included in a rotary compressor that is an existing product constituted in accordance with a different specification, it is possible to prevent an increase in a cost of parts included in the rotary compressor 1 according to the embodiment, and it is possible to improve a decrease in the manufacturing cost.

Furthermore, the rotary compressor 1 according to the embodiment may have a structure in which component elements except for the accumulator container 25, the gas-liquid separation tube 31, the accumulator suction pipe 27, and the communication pipe 104, may be common to the component elements included in a rotary compressor (hereinafter, also referred to as a rotary compressor constituted in accordance with a different specification, which is not illustrated) in which an accumulator container (not illustrated) and a compressor main body container are arranged side by side in the radial direction (horizontal direction). As a result of this, in the rotary compressor 1 according to the embodiment, by diverting parts included in the rotary compressor that is the existing product constituted in accordance with a different specification (for example, the compressor main body container 10, the motor 11, and the compression section 12), as the component elements other than the accumulator container 25, the gas-liquid separation tube 31, the accumulator suction pipe 27, and the communication pipe 104, it is possible to improve a reduction in the manufacturing cost by using an existing manufacturing facility for existing products as a manufacturing facility according to the present embodiment.

The compression section 12 includes a cylinder 121, an upper end plate 160T, a lower end plate 160S, and a rotation shaft 15, and the upper end plate 160T, the cylinder 121, and the lower end plate 160S are laminated in this order and are secured by a plurality of bolts 175. The upper end plate 160T is provided with a main bearing portion 161T. The lower end plate 160S is provided with a secondary bearing portion 161S. The rotation shaft 15 is provided with a main shaft portion 153, an eccentric portion 152, and a secondary shaft portion 151. The main shaft portion 153 of the rotation shaft 15 is fitted into the main bearing portion 161T of the upper end plate 160T, and the secondary shaft portion 151 of the rotation shaft 15 is fitted into the secondary bearing portion 161S of the lower end plate 160S, so that the rotation shaft 15 is rotatably supported.

The motor 11 includes a stator 111 that is arranged on an outer side, and a rotor 112 that is arranged on an inner side. The stator 111 is secured to the inner circumferential surface of the main shell 10*a* by using a shrink fit process. The rotor 112 is secured to the rotation shaft 15 by using a shrink fit process.

In the interior portion of the compressor main body container 10, in order to lubricate a sliding member of the compression section 12 and seal a high pressure section and a low pressure section that are included in a compression chamber, the lubricating oil 18 with an amount, which is enough to substantially immerse the compression section 12, is enclosed.

In the following, the compression section 12 will be described in detail with reference to FIG. 2.

A hollow portion 130 having a cylindrical shape is provided in the interior portion of the cylinder 121, and a piston 125 is arranged at the hollow portion 130. The piston 125 is fitted into the eccentric portion 152 of the rotation shaft 15. The cylinder 121 is provided with a groove portion that is outwardly provided from the hollow portion 130, and a vane 127 is arranged at the groove portion. The cylinder 121 is provided with a spring hole 124 leading from the outer circumference to the groove portion, and a spring 126 is arranged in the spring hole 124. As a result of one end of the vane 127 being pressed against the piston 125 by the spring 126, an outer space of the piston 125 is divided into a suction chamber 133 and a discharge chamber 131 at the hollow portion 130 of the cylinder 121. The cylinder 121 is provided with a suction hole 135 that communicates from the outer circumference to the suction chamber 133. The compression section suction pipe 102 is connected to the suction hole 135. The upper end plate 160T is provided with a discharge hole 190, which passes through the upper end plate 160T and communicates with the discharge chamber 131. On the upper end plate 160T, a discharge valve 200 that opens and closes the discharge hole 190, and a discharge valve holder 201 that prevents warpage of the discharge valve 200, are secured by a rivet 202. On the upper side of the upper end plate 160T, an upper end plate cover 170, which covers the discharge hole 190, is arranged, so that an upper end plate cover chamber 180, which is blocked by the upper end plate 160T and the upper end plate cover 170, is formed. The upper end plate cover 170 is secured to the upper end plate 160T by the plurality of bolts 175 each of which secures the upper end plate 160T and the cylinder 121. The upper end plate cover 170 is provided with an upper end plate cover discharge hole 172 that communicates between the upper end plate cover chamber 180 and the interior portion of the compressor main body container 10.

In the following, a flow of a refrigerant, which is sucked in by a rotation of the rotation shaft 15, will be described.

The piston 125, which is fitted into the eccentric portion 152 of the rotation shaft 15, performs an orbital motion caused by a rotation of the rotation shaft 15, so that the suction chamber 133 sucks a refrigerant while increasing its volume. As a suction path of the refrigerant, a low pressure refrigerant in the refrigeration cycle, is sucked into the interior portion of the accumulator container 25 by way of the accumulator suction pipe 27, and, in the case where a liquid is mixed with the refrigerant that has been sucked into the accumulator container 25, the refrigerant is retained in a lower part of the accumulator container 25, and only the gas refrigerant is sucked into the gas-liquid separation tube 31 that is upwardly opened in the interior portion of the accumulator container 25. The gas refrigerant, sucked into the gas-liquid separation tube 31, is sucked into the suction chamber 133 after passing through the communication pipe 104 and the compression section suction pipe 102. If an amount of the liquid refrigerant out of the refrigerant that is sucked from the refrigeration cycle, the liquid level of the liquid refrigerant becomes higher than an open end 31*b* of the gas-liquid separation tube 31 in the interior portion of the accumulator container 25, and a large amount of liquid refrigerant may possibly flow into the gas-liquid separation tube 31. If a large amount of liquid refrigerant flows into the compression section 12 through the gas-liquid separation tube 31, this causes damage to the compression section 12. In order to prevent a large amount of liquid refrigerant from flowing into the gas-liquid separation tube 31, the gas-liquid separation tube 31 is provided with the liquid return hole 34 that is used to suck the liquid refrigerant into the gas-liquid separation tube 31 little by little.

In the following, a flow of a refrigerant, which is discharged by a rotation of the rotation shaft 15, will be described.

The piston 125, which is fitted into the eccentric portion 152 of the rotation shaft 15, performs an orbital motion caused by a rotation of the rotation shaft 15, so that the discharge chamber 131 compresses the refrigerant while contracting its volume, and, if a pressure of the compressed refrigerant is higher than a pressure of the upper end plate cover chamber 180 disposed on the outer side of the discharge valve 200, the discharge valve 200 is opened, and then, the refrigerant is discharged from the discharge chamber 131 to the upper end plate cover chamber 180. The refrigerant, discharged to the upper end plate cover chamber 180, is discharged into the compressor main body container 10 from the upper end plate cover discharge hole 172 that is provided in the upper end plate cover 170.

The refrigerant, which has been discharged into the compressor main body container 10, is guided to an upper part of the motor 11 after passing through a notch (not illustrated) that is provided around the outer circumference of the stator 111 and that communicates between an upper and lower portions of the motor 11, or passing through a gap with a winding portion of the stator 111 (not illustrated) or a gap 115 between the stator 111 and the rotor 112 (see FIG. 1), and is discharged to the refrigeration cycle from the discharge pipe 107 that is provided in the top shell 10*b*.

In the following, a flow of the lubricating oil 18 will be described.

The lubricating oil 18, which is enclosed in the lower part of the compressor main body container 10, is supplied to the compression section 12 after passing through the interior portion (not illustrated) of the rotation shaft by a centrifugal force generated by the rotation shaft. The lubricating oil 18, supplied to the compression section 12, is mixed with the refrigerant, is turned into a mist state, and is discharged to the interior portion of the compressor main body container 10 together with the refrigerant. The lubricating oil 18, which has been turned into a mist state and discharged into the interior portion of the compressor main body container 10, is separated from the refrigerant by the centrifugal force by a rotational force of the motor 11, and returns to the lower part of the compressor main body container 10 again in the form of oil drops. However, some of the lubricating oil 18 is not separated and is discharged to the refrigeration cycle together with the refrigerant. The lubricating oil 18, which has been discharged into the refrigeration cycle, returns to a accumulator container 25*a* after circulating the refrigeration cycle, is separated at the interior portion of the accumulator container 25, and is retained in the lower part of the accumulator container 25. The lubricating oil 18, retained in the lower part of the accumulator container 25, flows into the gas-liquid separation tube 31 little by little after passing through the liquid return hole 34 together with the liquid refrigerant, and is sucked into the suction chamber 133 together with the sucked refrigerant.

(Characteristic Configuration of Rotary Compressor)

In the following, a characteristic configuration of the rotary compressor 1 according to the embodiment will be described.

The compressor main body container 10, which accommodates the compression section 12 and the motor 11, is formed by securing the opening side 10*g* of the top shell 10*b* having a cup shape, to the upper end portion of the main shell 10*a* having a vertical cylindrical shape by performing a welding process, and by securing the opening side 10*d* of the bottom shell 10*c* having a cup shape, to the lower end portion of the main shell 10*a* by performing a welding process. the accumulator container 25 is constituted such that the interior portion of the accumulator shell 26 is hermetically sealed by securing the opening side 26*a* of the accumulator shell 26 to the opposite opening side 10*e* of the bottom shell 10*c*, by performing a welding process, at the third welded portion X that is a position lower than the second welded portion W between the main shell 10*a* and the bottom shell 10*c* that are included in the compressor main body container 10.

Effects of Embodiment

In the following, the present embodiment will be described by comparing to Patent Literatures 1 to 3 that are described above.

The compressor described in Patent Literature 1 includes the compressor main body container and the accumulator container as the containers that are formed independently of each other, whereas the rotary compressor 1 according to the embodiment uses the bottom shell 10*c* as both a part of the compressor main body container 10 and a part of the accumulator container 25.

The compressor described in Patent Literature 2 is constituted such that the main shell and the accumulator shell are welded to the bottom shell at a single welded portion, whereas the rotary compressor 1 according to the embodiment is constituted such that each of the second welded portion W between the bottom shell 10*c* and the main shell 10*a*, and the third welded portion X between the bottom shell 10*c* and the accumulator shell 26, is independently provided, and furthermore, the opening side 26*a* of the bottom shell 10*c* is welded to the main shell 10*a*, and the accumulator shell 26 is welded to the opposite opening side 10*e* of the bottom shell 10*c*.

The compressor described in Patent Literature 3 is constituted such that the interior portion of the single container is divided into the compressor main body container and the accumulator container by the pressure partition wall, whereas the rotary compressor 1 according to the embodiment is constituted such that the accumulator container 25 is welded to the compressor main body container 10, which has been independently formed, by using a part of the compressor main body container 10 as a part of the accumulator container 25.

As described above, the rotary compressor 1 according to the embodiment is constituted such that the bottom shell 10*c* simultaneously serves as the part of the compressor main body container 10 and the part of the accumulator container 25, so that it is possible to provide a compressor in which the manufacturing cost of the rotary compressor 1 is reduced as compared to the structure in which the compressor main body container and the accumulator container are independently constituted. Furthermore, the second welded portion W between the bottom shell 10*c* and the main shell 10*a* is separately disposed at another position of the third welded portion X between the bottom shell 10*c* and the accumulator shell 26, and furthermore, the opening side 10*d* of the bottom shell 10*c* is welded to the main shell 10*a*, whereas the accumulator shell 26 is welded to the opposite opening side 10*e* of the bottom shell 10*c*, whereby the second welded portion W and the third welded portion X are formed independently of each other. As a result of this, as with the structure in which a single common welded portion is provided, it is possible to avoid the refrigerant gas from flowing from the main shell to the accumulator shell passing through a poor weld portion that is generated at a single welded portion. As a result of this, with the rotary compressor 1 according to the present embodiment, it is possible to prevent a leakage of the refrigerant gas flowing from the compressor main body container 10 to the accumulator container 25 even when a poor weld portion is generated at one of the second welded portion W and the third welded portion X, and it is thus possible to easily detect the poor weld portion occurring between the second welded portion W and the third welded portion X, so that it is possible to provide a highly reliable compressor.

Furthermore, with the rotary compressor 1 according to the embodiment, between the both end portions of the gas-liquid separation tube 31, the end portion disposed on the side to which the communication pipe 104 is formed to have an expanded diameter such that one of the end portions is able to be inserted into the communication pipe 104. As a result of this, it is possible to easily connect the gas-liquid separation tube 31 and the communication pipe 104 by simply inserting the communication pipe 104 into the end portion of the gas-liquid separation tube 31 that is formed to have an expanded diameter on the outside of the accumulator container 25. Furthermore, between the both end portions of the compression section suction pipe 102, the end portion disposed on the side, to which the communication pipe 104 is connected, is formed to have an expanded diameter such that the other of the end portions of the communication pipe 104 is able to be inserted. As a result of this, it is possible to easily connect the compression section suction pipe 102 and the communication pipe 104 by simply inserting the communication pipe 104 into the end portion of the compression section suction pipe 102 that is formed to have an expanded diameter on the outside of the compressor main body container 10. In addition, with the rotary compressor 1 according to the embodiment, in each of the gas-liquid separation tube 31 and the compression section suction pipe 102, the end portion disposed on the side, which is connected to the communication pipe 104, is formed to have an expanded diameter on the outside of the compressor main body container 10 and the accumulator container 25. As a result of this, it is possible to easily connect the both end portions of the communication pipe 104 to each of the end portions of the two pipes (the gas-liquid separation tube 31 and the compression section suction pipe 102) that are formed to have respective expanded diameters by a single insertion operation.

Furthermore, the rotary compressor 1 according to the embodiment is constituted such that, between the both of the end portions of the communication pipe 104, the end portion disposed on the side, which is connected to the gas-liquid separation tube 31, is bent along the radial direction of the accumulator container 25. As a result of this, it is possible to easily connect the one end portion of the communication pipe 104 to the gas-liquid separation tube 31 by moving the one end portion of the communication pipe 104 inward in the radial direction of the accumulator container 25. Furthermore, between the both end portions of the communication pipe 104, the end portion disposed on the side, which is connected to the compression section suction pipe 102, is bent along the radial direction of the compressor main body container 10. As a result of this, it is possible to easily connect the other end portion of the communication pipe 104 to the compression section suction pipe 102 by moving the other end portion of the communication pipe 104 inward in the radial direction of the compressor main body container 10. In addition, in the rotary compressor 1 according to the embodiment, the communication pipe 104 extends along the vertical direction of the compressor main body container 10 and the accumulator container 25, the both end portions (i.e., the end portion disposed on the side that is connected to the gas-liquid separation tube 31, and the end portion disposed on the side that is connected to the compression section suction pipe 102) of the communication pipe 104, are bent along the radial direction of the compressor main body container 10 and the accumulator container 25. As a result of this, it is possible to easily connect the both end portions of the communication pipe 104 to each of the two pipes (the gas-liquid separation tube 31 and the compression section suction pipe 102) by a single operation of moving these two pipes inward in the radial direction of the compressor main body container 10 and the accumulator container 25. As a result of this, it is possible to easily perform a connection operation between the communication pipe 104 and the gas-liquid separation tube 31, and a connection operation between the communication pipe 104 and the compression section suction pipe 102, and also, it is possible to form each of the pipes of the gas-liquid separation tube 31, the compression section suction pipe 102, and the communication pipe 104 in a simple shape. Consequently, it is possible to suppress an increase in the manufacturing cost of the rotary compressor 1.

Furthermore, in the rotary compressor 1 according to the embodiment, the accumulator shell 26 has a bottom surface that has a concave shape curved in a downward direction of the accumulator shell 26, and, in the interior portion of the accumulator shell 26, the gas-liquid separation tube 31 is bent along the bottom surface of the accumulator shell 26. As a result of this, it is possible to arrange the gas-liquid separation tube 31 at a position closer to the vicinity of the bottom surface of the accumulator shell 26. In addition, the liquid return hole 34, which causes the liquid refrigerant to be sucked into the gas-liquid separation tube 31 little by little, is arranged at a portion along the bottom surface of the accumulator shell 26 that is formed to have a structure in which a part of the gas-liquid separation tube 31 is bent, so that it is possible to easily return the lubricating oil 18 to the compression section 12 by way of the liquid return hole 34 together with the liquid refrigerant, accumulated in the bottom portion of the accumulator shell 26, and it is thus possible to appropriately seal the compression section 12 by the lubricating oil 18.

Furthermore, in the rotary compressor 1 according to the embodiment, the fourth welded portion between the gas-liquid separation tube 31 and the accumulator container 25, the fifth welded portion between the accumulator suction pipe 27 and the accumulator container 25, and the sixth welded portion between the gas-liquid separation tube 31 and the communication pipe 104, are provided on the outside of the accumulator container 25. Moreover, in the rotary compressor 1, the seventh welded portion between a guide tube 101 and the compressor main body container 10, the eighth welded portion between the guide tube 101 and the compression section suction pipe 102, and the ninth welded portion between the compression section suction pipe 102 and the communication pipe 104, are provided on the outside of the compressor main body container 10. As a result of this, it is possible to easily detect a leakage of the refrigerant gas leaking from the fourth welded portion to the ninth welded portion on the outside of the rotary compressor 1, and it is thus possible to form an appropriate welded portion by repairing the poor weld occurring at each of the welded portions.

Furthermore, in the rotary compressor 1 according to the embodiment, the component elements except for the accumulator container 25, the gas-liquid separation tube 31, the accumulator suction pipe 27, and the communication pipe 104, are common to the component elements included in a rotary compressor that is constituted in accordance with a different specification and in which an accumulator container and a compressor main body container are provided side by side in the radial direction. As a result of this, in the rotary compressor 1, by diverting the parts (for example, the compressor main body container 10, the motor 11, and the compression section 12) of the rotary compressor constituted in accordance with the different specification, it is possible to improve a reduction in the manufacturing cost by using an existing manufacturing facility as a manufacturing facility of the present embodiment.

Furthermore, the rotary compressor 1 according to the embodiment is formed such that the accumulator shell 26 is supported by the base member 310, which is used by a rotary compressor that is constituted in accordance with the different specification, and is formed such that the shape of the lower part of the accumulator shell 26 is supported by the base member 310. In this way, the base member 310 is used as a part, which is common to the rotary compressor that is constituted in accordance with the different specification, it is possible to prevent an increase in a cost of parts of the rotary compressor 1, and improve a decrease in the manufacturing cost.

In the following, a modification will be described with reference to drawings. In the modification, components having the same configuration as those described in the embodiment are assigned the same reference numerals as those assigned in the embodiment and descriptions thereof will be omitted.

MODIFICATION

Figure 3:
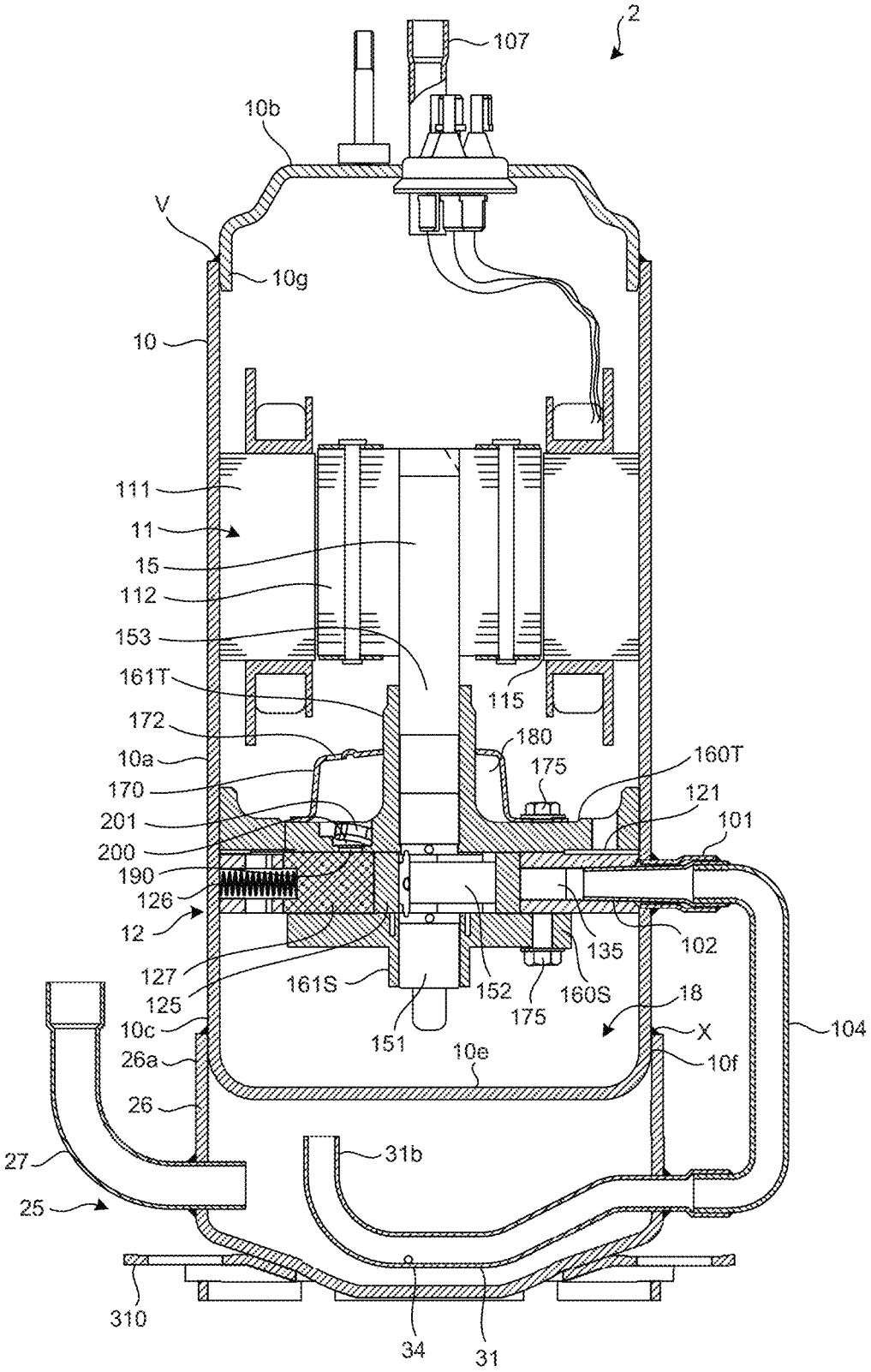
FIG. 3 is a longitudinal sectional diagram illustrating a relevant part of a rotary compressor according to a modification.

FIG. 3 is a longitudinal sectional diagram illustrating a relevant part of a rotary compressor 2 according to a modification. As in the modification illustrated in FIG. 3, the main shell 10*a* and the bottom shell 10*c*, which are included in the compressor main body container 10, are integrally formed by performing press working (press molding) on the steel plate member. The opening side 26*a* of the accumulator shell 26 having a cup shape, is secured to an outer circumference wall 10*f* of the bottom shell 10*c*, which is formed integrally with the main shell 10*a* by performing a welding process.

In also the rotary compressor 2 according to the modification, the bottom shell 10*c* is constituted by simultaneously using a part of the compressor main body container 10 and a part of the accumulator container 25, so that it is possible to provide a compressor, in which the manufacturing cost of the rotary compressor 2 is reduced.

Furthermore, by integrally forming the main shell 10*a* and the bottom shell 10*c*, included in the compressor main body container 10, by performing press working on steel plate members, the second welded portion W between the main shell 10*a* and the bottom shell 10*c* is eliminated, which makes it possible to prevent a leakage from the compressor main body container 10 to the accumulator container 25 caused by a poor weld process, and it is possible to provide a highly reliable compressor.

In addition, the rotary compressor according to the present embodiment is not limited to a rotary compressor having a single cylinder, i.e., what is called a single-cylinder-type rotary compressor, but may be applied to a rotary compressor having two cylinders, i.e., what is called a two-cylinder-type rotary compressor. Moreover, the present embodiment has been described of the rotary compressor as one example; however, for example, the present embodiment may be applied to a compressor, such as a scroll compressor, using another compression method and the same effect as that described in the present embodiment is obtained.

REFERENCE SIGNS LIST

1, 2 rotary compressor
10 compressor main body container
10*a* main shell
10*b* top shell
10*c* bottom shell
10*d* opening side of bottom shell
10*e* opposite opening side of bottom shell
10*f* outer circumference wall of bottom shell
10*g* opening side of top shell
11 motor
12 compression section
15 rotation shaft
18 lubricating oil
25 accumulator container
26 accumulator shell
26*a* opening side of accumulator shell
27 accumulator suction pipe
31 gas-liquid separation tube
31*b* open end of gas-liquid separation tube
34 liquid return hole
101 guide tube
102 compression section suction pipe
104 communication pipe
107 discharge pipe
111 stator
112 rotor
121 cylinder
124 spring hole
125 piston
126 spring
127 vane
130 hollow portion
131 discharge chamber
133 suction chamber
135 suction hole
151 secondary shaft portion
152 eccentric portion
153 main shaft portion
160T upper end plate
160S lower end plate
161T main bearing portion
161S secondary bearing portion
170 upper end plate cover
172 upper end plate cover discharge hole
175 bolt
180 upper end plate cover chamber
190 discharge hole
200 discharge valve
201 discharge valve holder
202 rivet
310 base member
V first welded portion between top shell and main shell
W second welded portion between main shell and bottom shell
X third welded portion between bottom shell and accumulator shell

The invention claimed is:

1. A hermetic type compressor in which, in an interior portion of a compressor main body container having a vertical cylindrical shape, a compression section that sucks and compresses a refrigerant and that discharges the refrigerant into the compressor main body container, and a motor that drives the compression section are accommodated, and that includes, below the compressor main body container, an accumulator container that separates a refrigerant, sucked from a refrigeration cycle, into a gas refrigerant and a liquid refrigerant, and that supplies the gas refrigerant to the compression section, wherein the compressor main body container includes a main shell having a vertical cylindrical shape, a top shell having a cup shape, and a bottom shell having a cup shape, and in which an interior portion of the main shell is hermetically sealed by securing an opening side of the top shell to an upper end portion of the main shell at a first welded portion by welding, and further by securing an opening side of the bottom shell to a lower end portion of the main shell at a second welded portion by welding, and the accumulator container includes an accumulator shell having a cup shape, and in which an interior portion of the accumulator shell is hermetically sealed by securing, by welding, an opening side of the accumulator shell to an opposite opening side of the bottom shell at a third welded portion that is located at a position lower than a position of the second welded portion in the compressor main body container, the hermetic type compressor comprising:

a gas-liquid separation tube that is provided by passing through the accumulator shell and that conveys the gas refrigerant from the interior portion of the accumulator container;

a communication pipe that is connected to the gas-liquid separation tube on an outside of the accumulator container;

a compression section suction pipe that is connected to the communication pipe and through which the compression section sucks the refrigerant by way of the communication pipe; and an accumulator suction pipe that is provided by passing through the accumulator shell, and that sucks the refrigerant into the interior portion of the accumulator container from the refrigeration cycle, wherein the gas-liquid separation tube has an end portion to which the communication pipe is connected, and into which one end portion of the communication pipe is inserted, the compression section suction pipe has an end portion to which the communication pipe is connected, and into which an other end portion of the communication pipe is inserted, and the outside of the accumulator container is provided with a fourth welded portion, in which the gas-liquid separation tube and the accumulator container are bonded, a fifth welded portion, in which the accumulator suction pipe and the accumulator container are bonded, and a sixth welded portion, in which the gas-liquid separation tube and the communication pipe are bonded.

2. The hermetic type compressor according to claim 1, wherein the communication pipe extends along a vertical direction of the compressor main body container and the accumulator container, and the one end portion and the other end portion of the communication pipe are bent along a radial direction of each of the compressor main body container and the accumulator container.

3. The hermetic type compressor according to claim 1, wherein the accumulator shell includes a bottom surface having a concave shape curved in a downward direction of the accumulator shell, and in the interior portion of the accumulator shell, the gas-liquid separation tube is bent along the bottom surface.

4. The hermetic type compressor according to claim 1, wherein component elements except for the accumulator container, the gas-liquid separation tube, the accumulator suction pipe, and the communication pipe included in the hermetic type compressor, are common to component elements included in another compressor, in which another accumulator container that separates the refrigerant, sucked from the refrigeration cycle, into the gas refrigerant and the liquid refrigerant, and that supplies the gas refrigerant to the compression section, is disposed side by side with the compressor main body container in a radial direction of the compressor main body container.

5. The hermetic type compressor according to claim 4, wherein the other compressor includes a base member that supports the compressor main body container, and the hermetic type compressor is formed such that the accumulator shell is supported by the base member, and a shape of a lower part of the accumulator shell is supported by the base member.

6. A hermetic type compressor in which, in an interior portion of a compressor main body container having a vertical cylindrical shape, a compression section that sucks and compresses a refrigerant and that discharges the refrigerant into the compressor main body container, and a motor that drives the compression section are accommodated, and that includes, below the compressor main body container, an accumulator container that separates a refrigerant, sucked from a refrigeration cycle, into a gas refrigerant and a liquid refrigerant, and that supplies the gas refrigerant to the compression section, wherein the compressor main body container includes a main body, in which a main shell having a vertical cylindrical shape and a bottom shell having a cup shape are integrally formed by performing press molding, and a top shell having a cup shape, and in which an interior portion of the main body is hermetically sealed by securing an opening side of the top shell to an upper end portion of the main shell by welding, and the accumulator container includes an accumulator shell having a cup shape, and in which an interior portion of the accumulator shell is hermetically sealed by securing an opening side of the accumulator shell to an outer circumference wall of the bottom shell by welding, the hermetic type compressor comprising:

a gas-liquid separation tube that is provided by passing through the accumulator shell and that conveys the gas refrigerant from the interior portion of the accumulator container;

a communication pipe that is connected to the gas-liquid separation tube on an outside of the accumulator container;

a compression section suction pipe that is connected to the communication pipe and through which the compression section sucks the refrigerant by way of the communication pipe; and an accumulator suction pipe that is provided by passing through the accumulator shell, and that sucks the refrigerant into the interior portion of the accumulator container from the refrigeration cycle, wherein the gas-liquid separation tube has an end portion to which the communication pipe is connected, and into which one end portion of the communication pipe is inserted, the compression section suction pipe has an end portion to which the communication pipe is connected, and into which an other end portion of the communication pipe is inserted, and the outside of the accumulator container is provided with a first welded portion, in which the gas-liquid separation tube and the accumulator container are bonded, a second welded portion, in which the accumulator suction pipe and the accumulator container are bonded, and a third welded portion, in which the gas-liquid separation tube and the communication pipe are bonded.

7. The hermetic type compressor according to claim 2, wherein the communication pipe extends along a vertical direction of the compressor main body container and the accumulator container, and the one end portion and the other end portion of the communication pipe are bent along a radial direction of each of the compressor main body container and the accumulator container.

8. The hermetic type compressor according to claim 2, wherein the accumulator shell includes a bottom surface having a concave shape curved in a downward direction of the accumulator shell, and in the interior portion of the accumulator shell, the gas-liquid separation tube is bent along the bottom surface.

9. The hermetic type compressor according to claim 2, wherein component elements except for the accumulator container, the gas-liquid separation tube, the accumulator suction pipe, and the communication pipe included in the hermetic type compressor, are common to component elements included in another compressor, in which another accumulator container that separates the refrigerant, sucked from the refrigeration cycle, into the gas refrigerant and the liquid refrigerant, and that supplies the gas refrigerant to the compression section, is disposed side by side with the compressor main body container in a radial direction of the compressor main body container.

10. The hermetic type compressor according to claim 9, wherein the other compressor includes a base member that supports the compressor main body container, and the hermetic type compressor is formed such that the accumulator shell is supported by the base member, and a shape of a lower part of the accumulator shell is supported by the base member.

11. A hermetic type compressor in which, in an interior portion of a compressor main body container having a vertical cylindrical shape, a compression section that sucks and compresses a refrigerant and that discharges the refrigerant into the compressor main body container, and a motor that drives the compression section are accommodated, and that includes, below the compressor main body container, an accumulator container that separates a refrigerant, sucked from a refrigeration cycle, into a gas refrigerant and a liquid refrigerant, and that supplies the gas refrigerant to the compression section, wherein the compressor main body container includes a main shell having a vertical cylindrical shape, a top shell having a cup shape, and a bottom shell having a cup shape, and in which an interior portion of the main shell is hermetically sealed by securing an opening side of the top shell to an upper end portion of the main shell at a first welded portion by welding, and further by securing an opening side of the bottom shell to a lower end portion of the main shell at a second welded portion by welding, and the accumulator container includes an accumulator shell having a cup shape, and in which an interior portion of the accumulator shell is hermetically sealed by securing, by welding, an opening side of the accumulator shell to an opposite opening side of the bottom shell at a third welded portion that is located at a position lower than a position of the second welded portion in the compressor main body container, the hermetic type compressor comprising:

a gas-liquid separation tube that is provided by passing through the accumulator shell and that conveys the gas refrigerant from the interior portion of the accumulator container;

a communication pipe that is connected to the gas-liquid separation tube on an outside of the accumulator container; and a compression section suction pipe that is connected to the communication pipe and through which the compression section sucks the refrigerant by way of the communication pipe, wherein the accumulator shell includes a bottom surface having a concave shape curved in a downward direction of the accumulator shell, and in the interior portion of the accumulator shell, the gas-liquid separation tube is bent along the bottom surface.

12. A hermetic type compressor in which, in an interior portion of a compressor main body container having a vertical cylindrical shape, a compression section that sucks and compresses a refrigerant and that discharges the refrigerant into the compressor main body container, and a motor that drives the compression section are accommodated, and that includes, below the compressor main body container, an accumulator container that separates a refrigerant, sucked from a refrigeration cycle, into a gas refrigerant and a liquid refrigerant, and that supplies the gas refrigerant to the compression section, wherein the compressor main body container includes a main body, in which a main shell having a vertical cylindrical shape and a bottom shell having a cup shape are integrally formed by performing press molding, and a top shell having a cup shape, and in which an interior portion of the main body is hermetically sealed by securing an opening side of the top shell to an upper end portion of the main shell by welding, and the accumulator container includes an accumulator shell having a cup shape, and in which an interior portion of the accumulator shell is hermetically sealed by securing an opening side of the accumulator shell to an outer circumference wall of the bottom shell by welding, a gas-liquid separation tube that is provided by passing through the accumulator shell and that conveys the gas refrigerant from the interior portion of the accumulator container, the hermetic type compressor comprising:

a communication pipe that is connected to the gas-liquid separation tube on an outside of the accumulator container; and a compression section suction pipe that is connected to the communication pipe and through which the compression section sucks the refrigerant by way of the communication pipe, wherein the accumulator shell includes a bottom surface having a concave shape curved in a downward direction of the accumulator shell, and in the interior portion of the accumulator shell, the gas-liquid separation tube is bent along the bottom surface.

* * * * *